US006558860B2

(12) United States Patent
Heemstra

(10) Patent No.: US 6,558,860 B2
(45) Date of Patent: May 6, 2003

(54) METHOD OF PRODUCING A SCREEN FOR A COLOR DISPLAY TUBE

(75) Inventor: Tewe Hiepke Heemstra, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 43 days.

(21) Appl. No.: 10/043,387

(22) Filed: Oct. 26, 2001

(65) Prior Publication Data

US 2002/0090559 A1 Jul. 11, 2002

(30) Foreign Application Priority Data

Oct. 31, 2000 (EP) ..... 00203790

(51) Int. Cl.[7] ..... H01J 9/227
(52) U.S. Cl. ..... 430/24
(58) Field of Search ..... 430/24; 396/546

(56) References Cited

U.S. PATENT DOCUMENTS 4,078,239 A * 3/1978 Prazak et al. ..... 354/1
4,135,930 A * 1/1979 Hosokoshi et al. ..... 96/36.1
4,226,513 A 10/1980 Shimoma et al. ..... 354/1
4,516,841 A * 5/1985 Ragland, Jr. ..... 354/1

* cited by examiner

*Primary Examiner*—John A. McPherson

(57) ABSTRACT

The invention relates to a method of producing a screen (6) having a striped structure of electroluminescent material on a display window (3) of a color display tube (1). In present day color display tubes (1), this screen (6) is produced using a photochemical process for exposing a photosensitive material which is applied to the display window (3). Normally, the exposure device used for this process comprises two lenses, a first lens (28) for correcting the rotation of the image of the elongated light source (22) and a second lens (27) for taking care that the landing position of the light on the display window (3) will be representative of the landing position of the electron beams (7), (8), (9) in the color display tube (1) when it is operated. Unfortunately, the prior art system has the disadvantage that the line-growth factor is not constant over the entire screen (6). As a result, a change in the amount of light in the exposure process leads to a change in the distribution of the line width over the screen (6) and hence to a change of the luminance distribution. This invention provides a solution to this problem by introducing a third lens element (35) into the exposure device. This lens element (35), that breaks the four-quadrant symmetry of the prior art system, enables a deliberate and controlled rotation of the image of the elongated light source (22) on the screen (6) in such a way that the line-growth factor is made constant over the entire screen (6). In a preferred embodiment, the first lens (28) and the third lens (35) are integrated to form one lens (36).

6 Claims, 9 Drawing Sheets

METHOD OF PRODUCING A SCREEN FOR A COLOR DISPLAY TUBE

The invention relates to a method of producing a screen having a striped structure of electroluminescent material on a display window of a colour display tube, which method comprises exposing a photosensitive material on the display window to light emitted by a elongated light source and passed through a lens system and a shadow mask, which shadow mask is suspended from the display window and which lens system is positioned between the elongated light source and the shadow mask, the lens system, forming an image of the elongated light source on the screen, comprising a first element for substantially correcting the rotation of the image of the elongated light source and a second element for substantially determining the landing position.

The invention also relates to a color display tube provided with a screen which is produced using the method.

A method of producing a screen for a color display tube as described in the opening paragraph is disclosed in the United States patent specification U.S. Pat. No. 4,226,513. This specification describes an exposure device for making a striped structure on the display window of a color display tube. The method uses an elongated light source and two so-called correction lenses. The first one, closest to the light source, prevents the rotation of the image of the elongated light source and the second one takes care of the landing aspects.

In colour display tubes where the luminescent material is applied in a striped structure, these stripes tend to zigzag near the edges of the screen. This zigzag form is due to the way the elongated light source is imaged on the display window. In general the mask and/or the display window are not completely flat, so that the longitudinal axis of the elongated light source and the axis through the slit shaped aperture of the shadow mask are not parallel, causing a rotation of the image of the elongated light source on the screen. The first correction lens in the exposure system counteracts this rotation. Inherently, these correction lenses are symmetric with respect to the long and the short axis along the screen.

The second correction lens serves to make sure that the light emitted by the elongated light source during the exposure process hits the screen at the same positions as the electron beams during operation of the color display tube.

Another important parameter of the exposure process is the line-growth factor. This parameter gives the increase in line width on the screen when the dose from the light source is increased. The prior art exposure process has the disadvantage that this line-growth factor is not constant for all positions on the screen. Due to an adjustment in the exposure process by changing the dose from the elongated light source or due to tolerances in the production process, the distribution of the line width over the entire screen is adversely influenced. This causes a deterioration with respect to the luminance distribution and the front of screen performance of the color display tube becomes worse.

It is an object of the invention to overcome the disadvantage of the prior art method by providing a method of producing a screen which delivers a constant line-growth factor for the entire screen.

According to the invention, this object is achieved by means of a method which is characterized in that the lens system further comprises a third element which is provided with means for adjusting the rotation of the image of the elongated light source over the entire screen.

The invention is based on the insight that the line-growth factor on the screen can be adjusted by deliberately introducing a rotation of the image of the elongated light source—also referred to as the lamp rotation—for each position on the screen. By deliberately rotating the image of the elongated light source, the width of the phosphor lines on the screen is influenced because the microscopic light distribution changes. The microscopic light distribution is the shape of the light spot as it is imaged by the elongated light source through the apertures in the shadow mask onto the screen. This shape, amongst others, is responsible for the line-growth factor.

In a further embodiment, the third element comprises a lens breaking the four-quadrant symmetry.

In the prior art method the first element corrects the rotation of the elongated light source. Due to the symmetry of the system, the vertical line through the centre—the north-south axis—has no rotation. Furthermore, the rotations in the four quadrants are mirror-symmetric. According to the present invention, the lamp rotation should be adjustable for all positions on the screen, i.e. also for positions on the north-south axis. Then, the distribution of the lamp rotation over the screen has lost its four-quadrant symmetry. To achieve this the third element should comprise a lens that breaks the mirror symmetry In a preferred embodiment, the first element and the third element are combined to form an integrated element.

When the first and the third element are integrated, it will be clear that the number of elements has not changed. This has the advantage that, because both the first and the third element are part of one and the same lens, no additional measures have to be taken in the exposure device to enable the implementation of the present invention. It is just a matter of replacing the 'prior art' element by the element according to the invention. So, integrating the first and the third element is a very cost-effective measure.

In a still further embodiment, the integrated element has a first side comprising both the first element and the third element.

This has the advantage that this optical element can be manufactured using the same production methods as for the manufacture of the first element according to the prior art.

The invention further relates to a color display tube provided with a screen which is produced using the method, and more particularly to a color display tube with a striped structure extending in a zigzag way in an area of the screen passing through the centre of the screen and extending parallel to the striped structure.

In prior art color-display tubes, the striped structure in the area around the north-south axis does not show any lamp-rotation, consequently, the presence of a zigzag in the striped structure in this area is a clear indication of the use of the method according to the invention.

These and other aspects of the invention will be apparent from and elucidated by way of non-limitative examples with reference to the drawings and the embodiment(s) described hereinafter.

Figure 1:
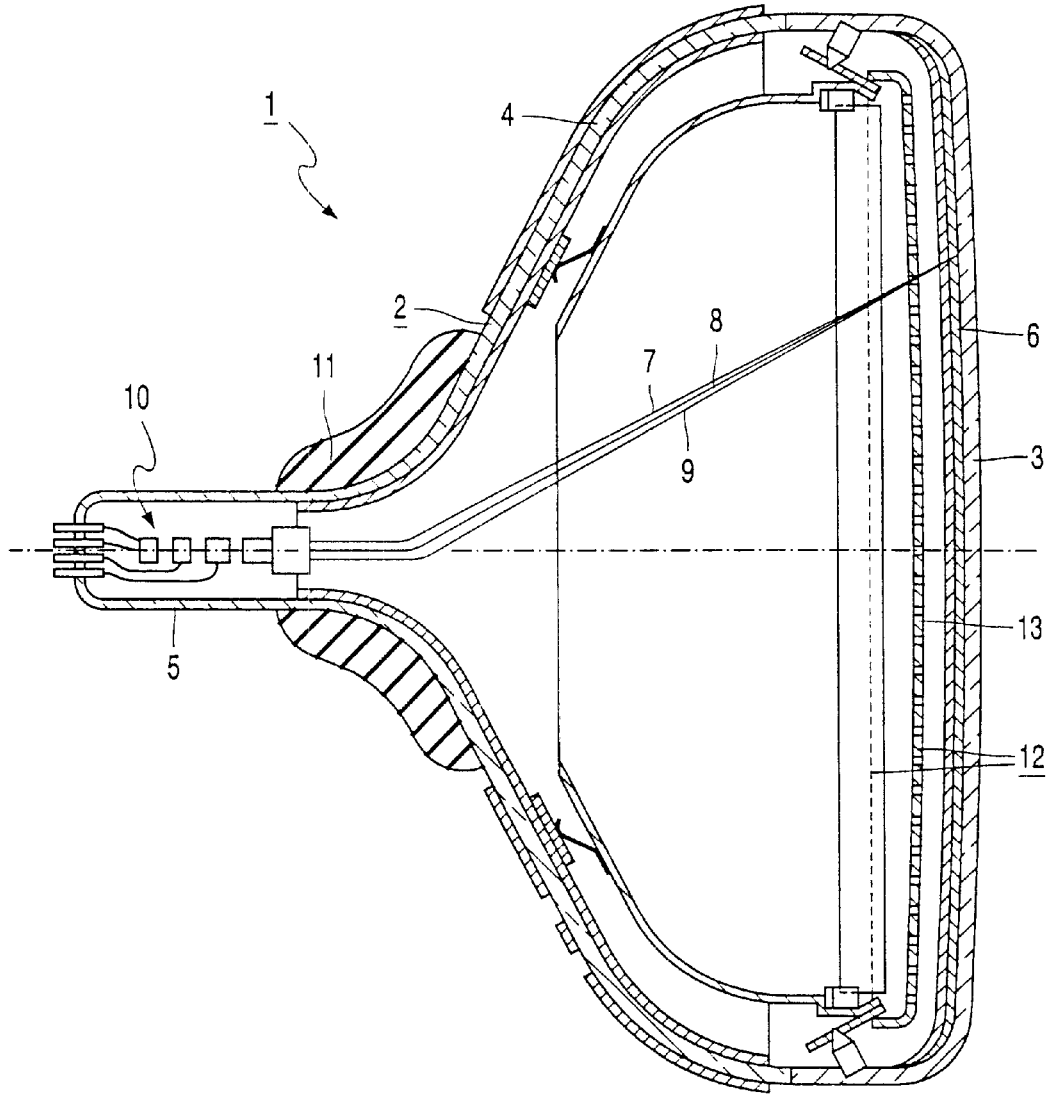
FIG. 1 is a sectional view of a color display tube.

The color display tube 1 shown in FIG. 1 comprises an evacuated glass envelope 2 with a display window 3, a funnel shaped part 4 and a neck 5. On the inner side of the display window 3 a screen 6 having a pattern of for example lines of phosphors luminescing in different colours (e.g. red, green and blue) may be arranged. The phosphor pattern is excited by the three electron beams 7, 8 and 9 that are generated by the electron gun 10. On their way to the screen the electron beams 7, 8 and 9 are deflected by the deflection unit 11 ensuring that the electron beams 7, 8 and 9 systematically scan the screen 6. Before the electrons hit the screen 6 they pass through a color selection electrode 12, which is suspended from the display window 3 and which comprises a shadow mask 13. The shadow mask 13 intersects the electron beams so that the electrons only hit the phosphor of the appropriate color. The shadow mask 13 may be a mask having elongate apertures, or a wire mask.

The screen 6 is manufactured in general by a photographic exposure process. In most present day color display tubes 1, the screen 6 has a black matrix structure and the electroluminescent material is applied in the apertures left free by the black matrix. It is also possible to have color display tubes without a black matrix structure.

The black matrix is produced by exposing a photosensitive material that is deposited on the inner side of the display window 3. After the black matrix layer has been applied, another photosensitive process is used for applying the phosphors, in three consecutive production steps for the three colours, to the areas of the display window 3 that were left free by the black matrix structure.

Figure 2:
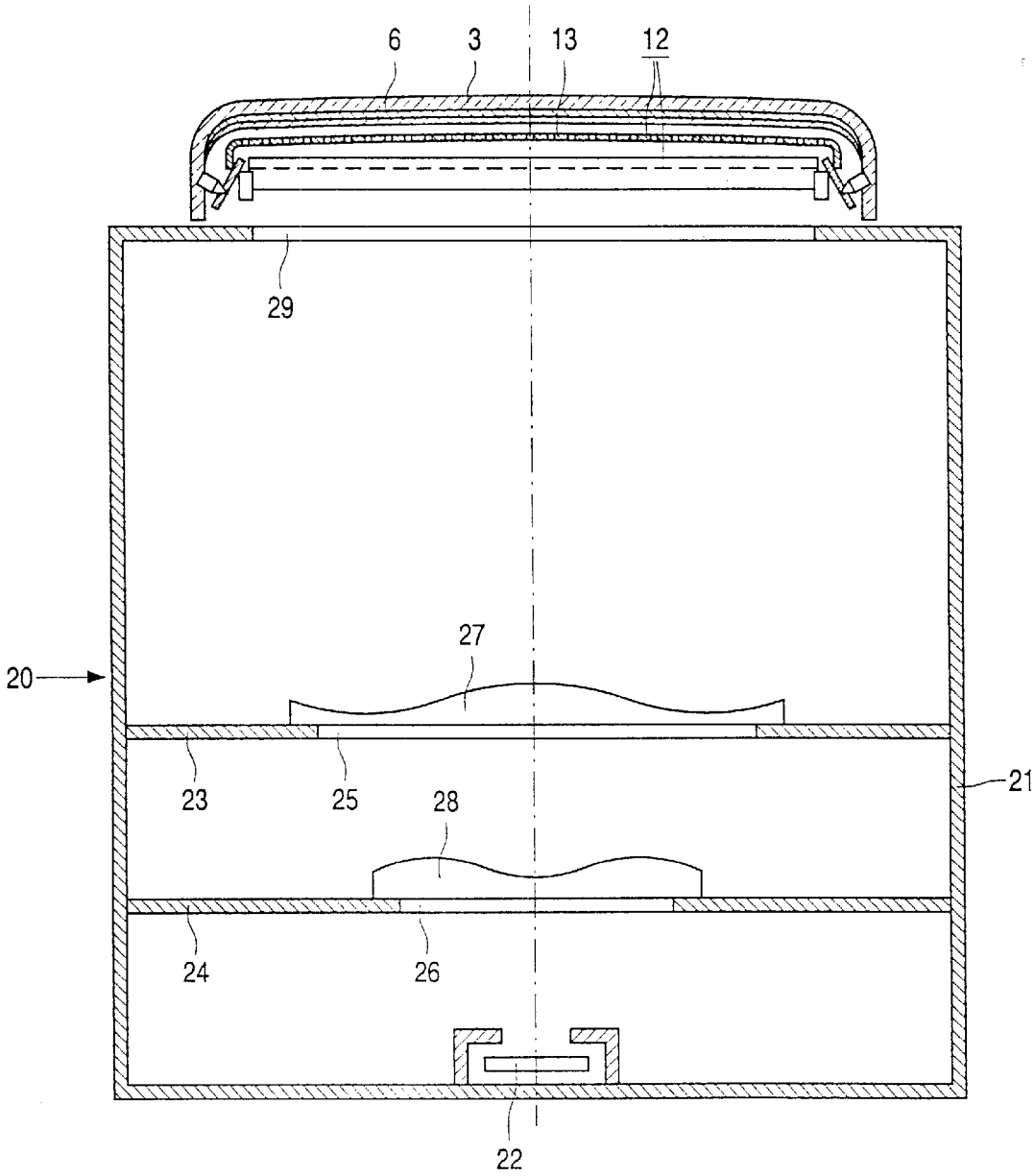
FIG. 2 is a diagrammatic vertical cross-section of a prior art lighthouse.

The lighthouse 20, as shown in FIG. 2, is the standard exposure equipment for exposing the photosensitive material on the inner side of a display window 3. At the bottom of the housing 21, an elongated light source 22 is positioned. The lighthouse 20 is provided with two supports 23, 24 with apertures 25, 26 for supporting the two lenses 27, 28. The light from the elongated light source 22 passes through these lenses 27, 28, travels through the aperture 29 in the top of the lighthouse 20 and through the shadow mask 13 towards the inner side of the display window 3 in order to expose the photosensitive material.

Figure 3A:
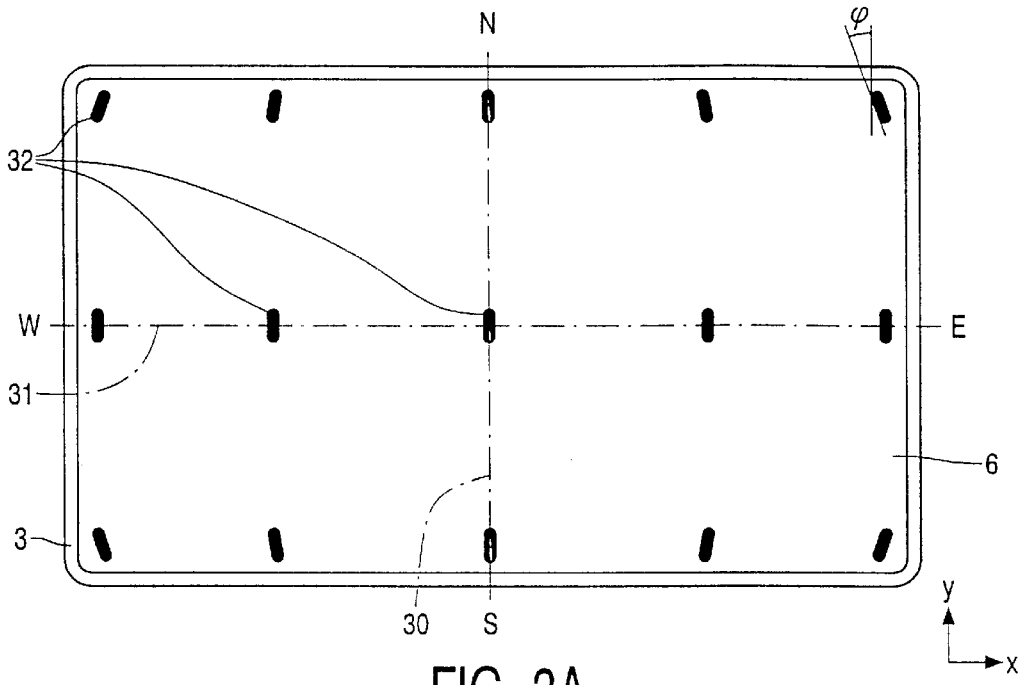
FIGS. 3A and 3B show the images of the elongated light source on the screen without and with the rotation correction lens.
Figure 3B:
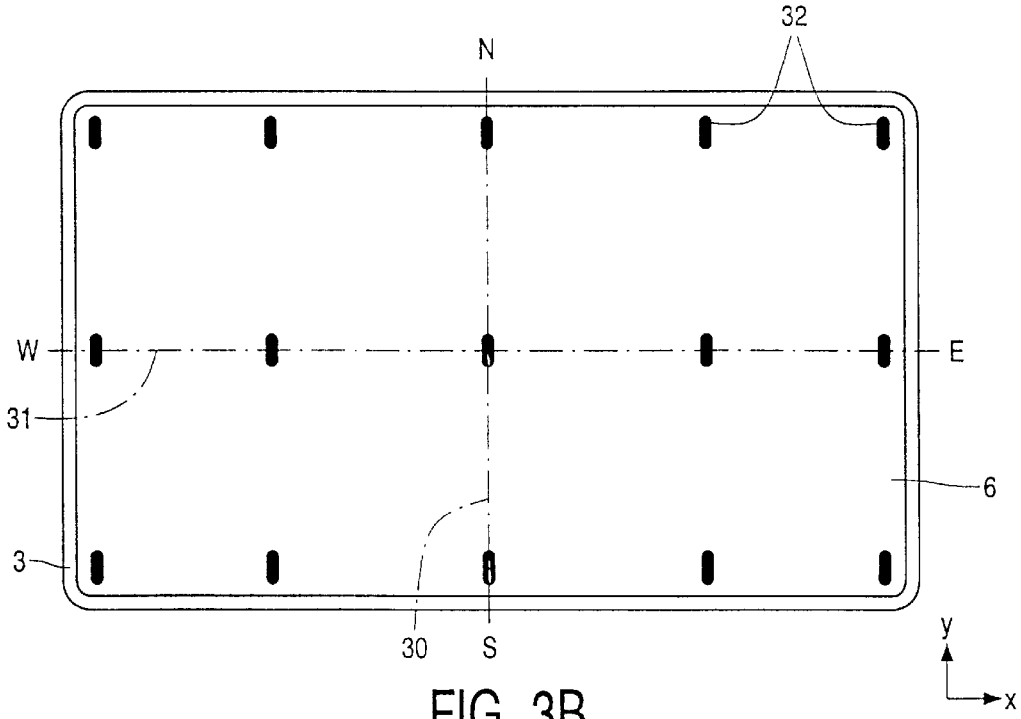

The function of the two lenses for exposing a color display tube 1 according to the prior art is distinct. The first lens 28, as seen in the direction of the light propagating from the elongated light source 22, serves to substantially correct the rotation of the image of the elongated light source 22 on the screen. By way of example, FIGS. 3A and 3B show a screen 6 in a display window 3 in the absence and in the presence of the first lens 28 respectively. In present day color display tubes 1 with a striped screen structure, the stripes of the screen are oriented in the vertical direction, i.e. the y-direction as indicated in FIGS. 3A/B. The elongated lamp is also oriented in the vertical direction and may be wobbled in this direction during the exposure process in order to prevent the tie bars of the shadow mask 13 from being imaged on the screen 6. FIG. 3A clearly shows that the images 32 of the elongated light source 22 are rotated especially in the corner regions of the screen 6. This lamp rotation is indicated by the angle of rotation (P. A rotation of this kind leads to a zigzag pattern of the matrix and phosphor lines in the east (E) and west (W) regions of the screen 6. Due to the symmetry of the entire system, the images 32 of the elongated light source 22 are not rotated about the axes of the screen, i.e. the N-S line 30 and the E-W line 31. The rotation pattern over the screen is mirror-symmetric with respect to both the horizontal and the vertical axis, i.e. it is four-quadrant symmetric.

The second lens 27 serves to substantially adjust the landing of the light spot in the proper place on the screen 6. During operation of a color display tube 1, the electron beams 7, 8, 9, generated by the electron gun 10 follow trajectories determined by the electron gun 10 and the deflection unit 11. The electron beams 7, 8, 9 pass through the shadow mask 13 and impinge on the corresponding phosphor. In order to obtain a color display tube 1 with a good landing performance, that is a good color purity, it is necessary that the light used during the manufacturing process for exposing the screen 6 hits the screen at the same positions as the electrons during operation. In order to achieve this a second lens 27 is necessary.

Because there is some interaction between the lenses 27 and 28, in practice, lens 27 will have an effect on the rotation of the image of the elongated light source 22 and lens 28 will slightly effect the landing. For that reason it is necessary to design both lenses 27, 28 as an entity.

Another quantity that is of major importance in the exposure process is the line-growth factor.

The elongated light source 22 is imaged on the screen 6. The shape of this image is referred to as the microscopic light distribution. This microscopic light distribution is mainly determined by three functions: the diffraction pattern of the elongated light source 22 behind the shadow mask 13, the profile of the elongated light source 22 and the x-component of the image of the wobbled elongated light source. Mathematically, the microscopic light distribution is the convolution of these three functions.

The exposure process can be regulated by changing the profile of the elongated light source 22. This can be done by changing the intensity or by changing the dose, which is the time integral over the intensity. The chemical properties of the photosensitive material used for this exposure process determine the line-growth factor. The line-growth factor determines the extent to which the line width of the black matrix aperture or the line width of the phosphor pattern changes when the amount of light is changed. This line-growth factor can for instance be expressed in $\mu$m/%, indicating the increase of the line width in $\mu$m per percent increase of the light dose.

Unfortunately, in the prior art exposure process the line-growth factor is not constant for all positions on the screen. This is a serious drawback of the prior art because when it is necessary in the manufacturing process to increase the line width on the screen, for instance because a higher luminance is desired, an increase of the light dose leads to an unbalanced increase of the line width across the screen. In other words, the luminance will increase, but the luminance distribution across the screen changes unwantedly. Also, due to tolerances in the exposure process a variation of the light dose not only may give rise to a changed luminance level but also to a changed luminance distribution.

Figure 4:
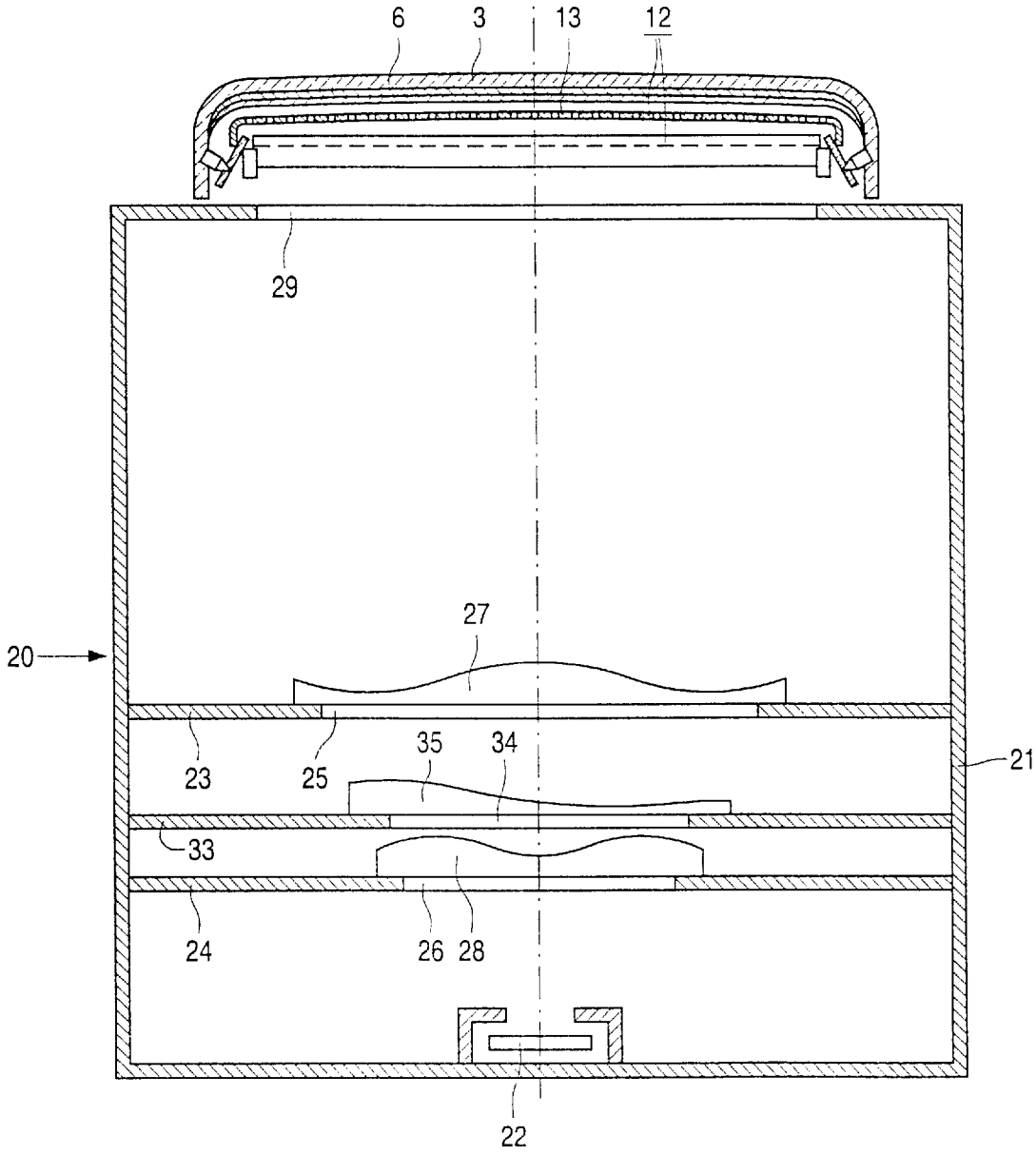
FIG. 4 is a diagrammatic vertical cross-section of a lighthouse according to the invention with a separate third element.
Figure 5:
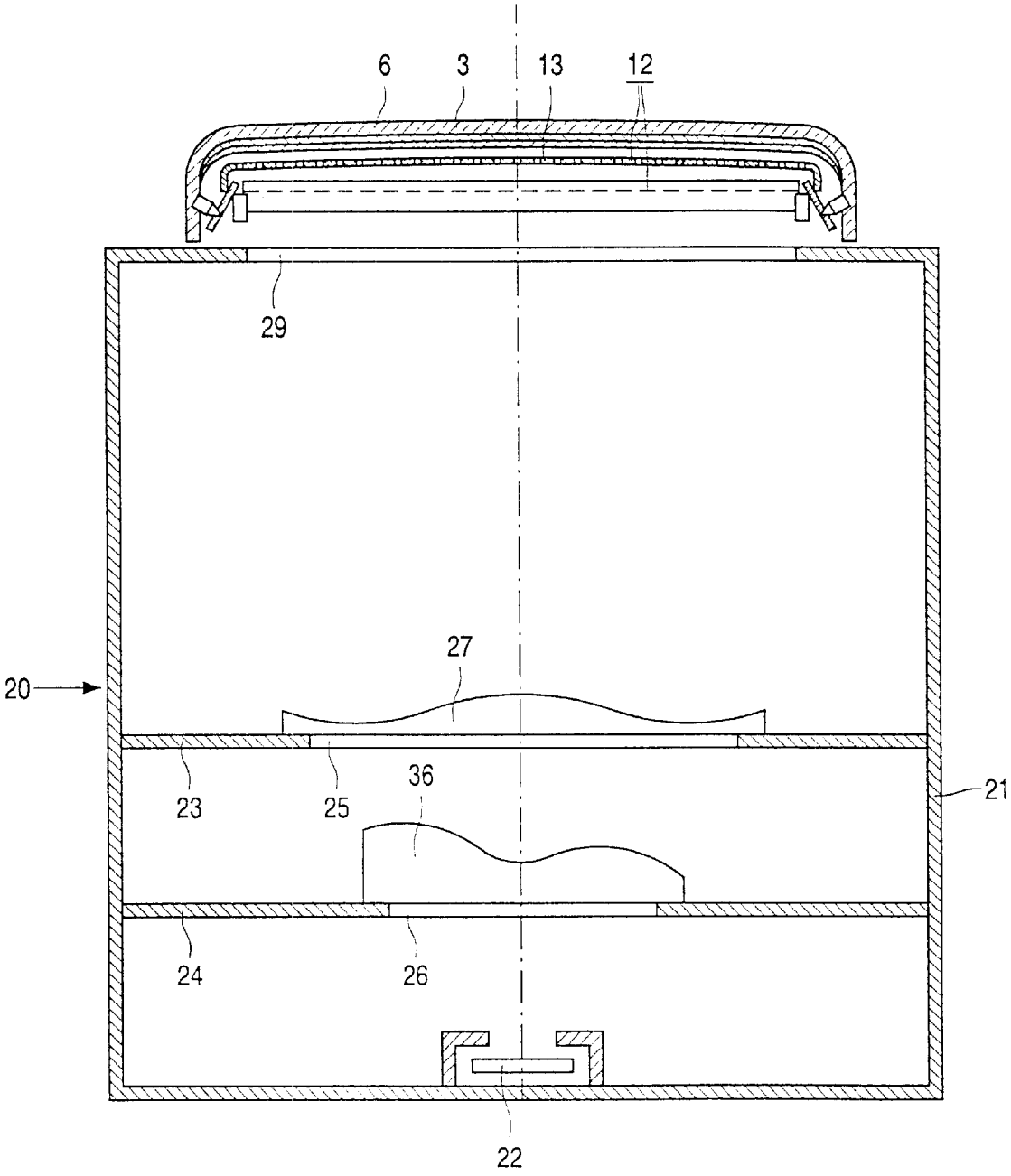
FIG. 5 is a diagrammatic vertical cross-section of a lighthouse according to the invention with a third element integrated with the first element.

The present invention provides a solution to this problem and a method of producing a screen, which uses an exposure process with a line-growth factor which is constant across the entire screen. It is recognized that the rotation of the image of the elongated light source 22 influences the x-component of the profile of the microscopic light distribution. So, the line-growth factor can be made constant across the entire screen 6 by deliberately rotating the image of the elongated light source in a proper way. This can be achieved by adding a third element to the lens system in the lighthouse 20. This is represented by FIG. 4, where an additional support 33 with an aperture 34 is provided with a lens 35, being the third element. As the line-growth factor must be adjustable across the entire screen 6, it is evident that it should also be possible to rotate the image of the elongated light source 22 about the two axes (the N-S and E-W axis). Consequently, the lens 35 breaks the four-quadrant symmetry of the prior art systems, and the lens 35 is no longer symmetric. In accordance with a preferred embodiment of such a lens 35, said lens is incorporated in the lens 28, being the first element, so that the first and the third element are integrated to form one combined element. This embodiment is given in FIG. 5, where lens 36 is designed to have the same lens action as the combination of the lenses 28 and 35. Such a combination of the first and the third lenses 28 and 35 has the advantage that the lighthouse 20 does not need any modifications when the invention is applied and that the manufacturing process for the lens itself does not have to be changed either. Of course, the introduction of a third element into the lens system does require a redesign of the second element due to the cross-talk between the lenses 27 and 36. The lens system has to be optimized as an entity.

Figure 6:
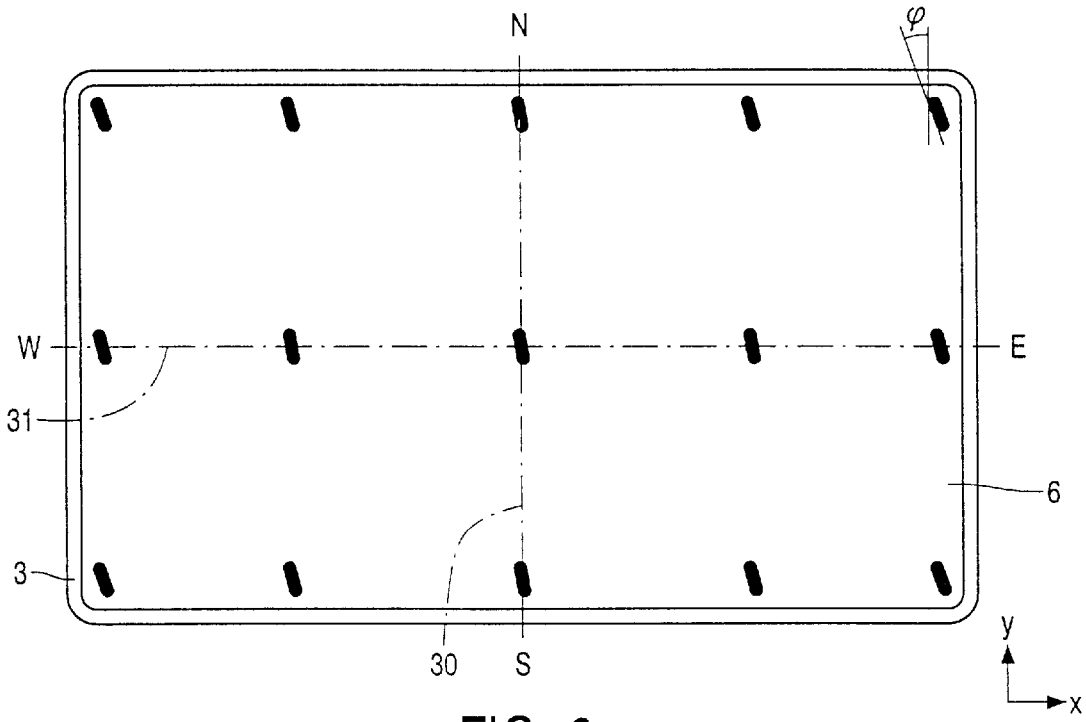
FIG. 6 is an example of the image of the elongated light source according to the invention with a constant line-growth factor over the screen.

In FIG. 6 an example is given of what the rotation of the images of the elongated light source 22 may look like when the invention is applied to the exposure system. Note that the requirement of a constant line-growth factor over the entire screen does not mean that the images of the elongated light source all have the same amount of rotation. This depends also on the curvature of the shadow mask 13 and the screen 6.

In order to illustrate the invention, a non-limitative example will be given to demonstrate that a lamp-rotation indeed leads to an increase of the line-growth factor.

The line-growth factors for different lamp rotations have been calculated for a corner of a 32" wide screen tube with a real flat outer display window surface (32"WSRF). For this calculation the geometry of the slotted apertures in the shadow mask 13 and of the black matrix pattern on the screen 6 are important. These parameters are given in Table 1.

TABLE 1

Some shadow mask and screen dimensions of the 32" WSRF

| 32" WSRF | Dimensions in $\mu$m |
|---|---|
| Horizontal mask aperture | 187 |
| Vertical mask aperture | 403 |
| Horizontal mask pitch | 850 |
| Vertical mask pitch | 547 |
| Matrix window width | 150 |
| Horizontal screen pitch | 1009 |

Figure 7A:
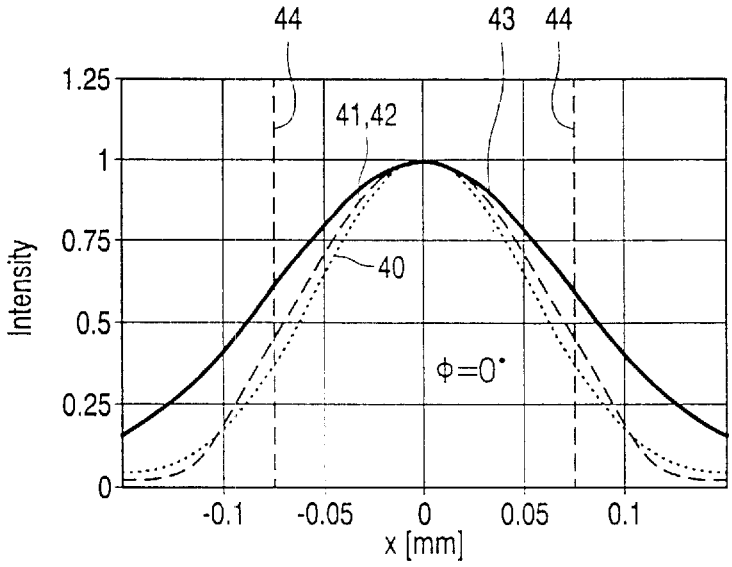
FIGS. 7A–7F are the microscopic light distributions calculated for different lamp-rotations.
Figure 7B:
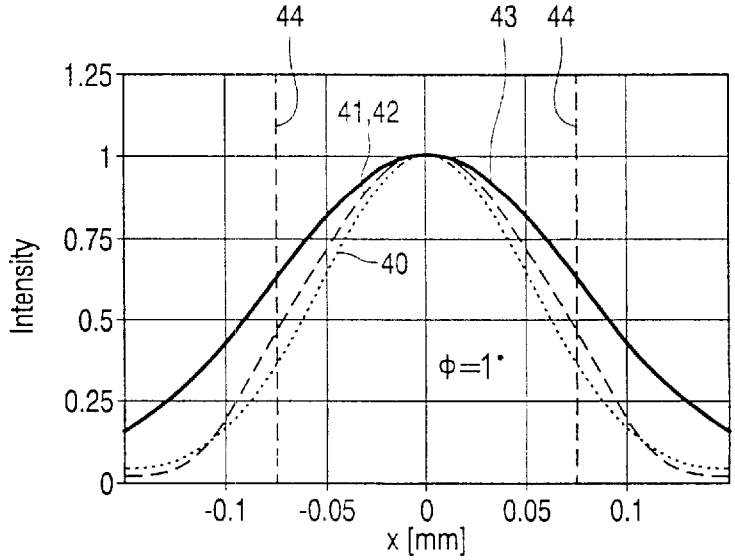
Figure 7C:
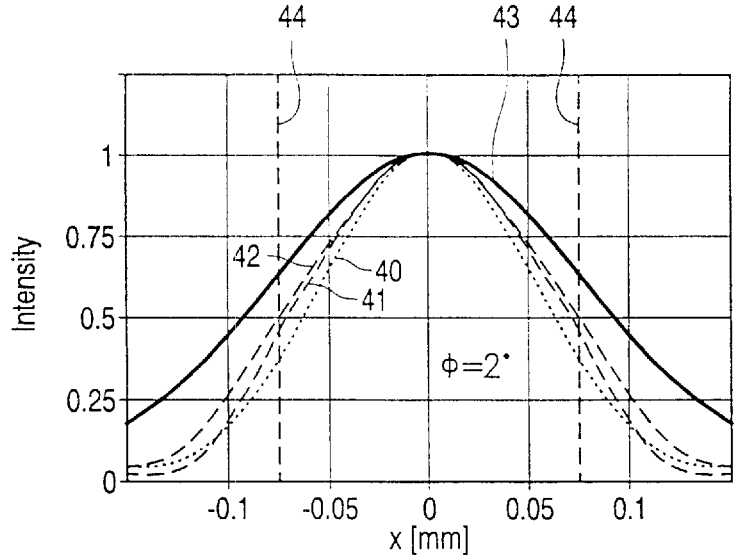
Figure 7D:
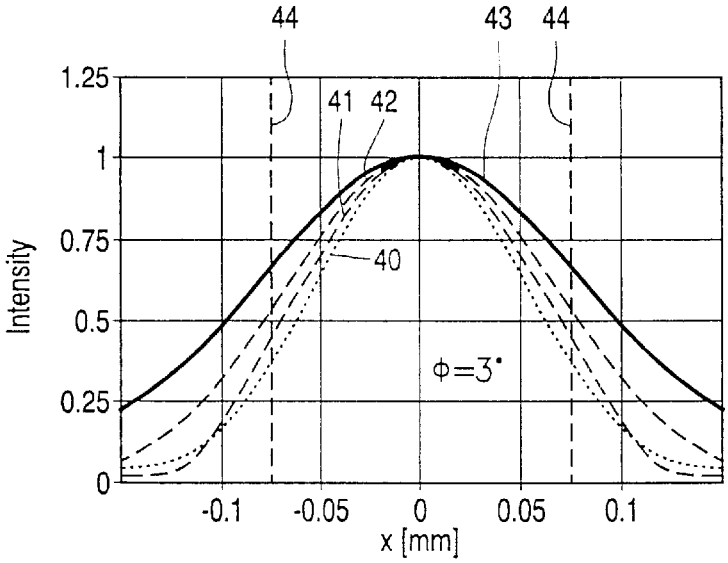
Figure 7E:
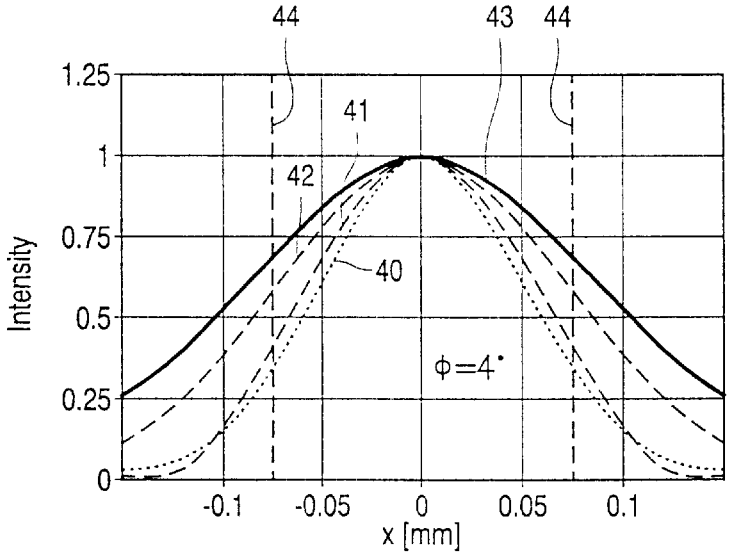
Figure 7F:
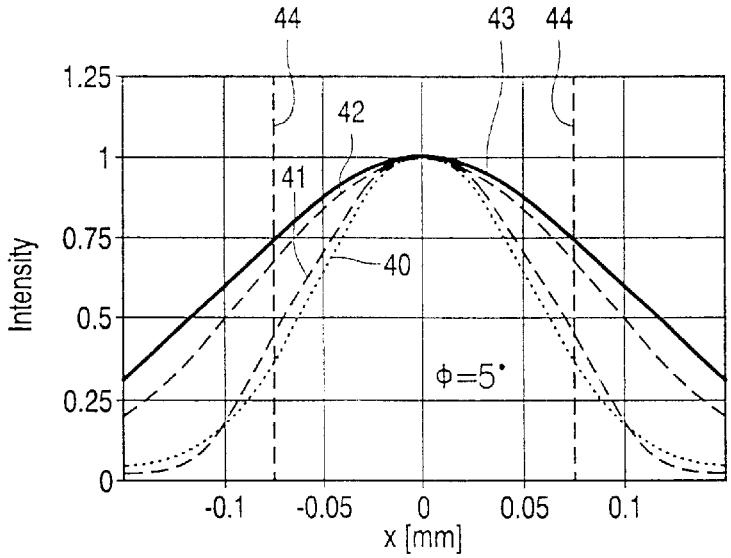

The matrix window width (MWW) is the line width between two adjacent matrix lines; in this area a phosphor line is applied. The MWW is a process parameter; given the aperture size and pitches of the mask, the MWW is determined by the exposure process. In the FIGS. 7A–7F, the microscopic light distribution is given for different lamp rotations $\phi$ between 0° and 5°. In these Figures the following curves can be distinguished: the diffraction pattern of the elongated light source 40; the profile of the elongated light source for the situations without lamp rotation 41 and with lamp-rotation 42; the microscopic light distribution 43 and the two vertical lines 44 between which the matrix window width is situated. Evidently, the curves 41 and 42 in FIG. 7A, where $\phi$=0°, coincide. The table shows that by increasing the lamp rotation, the profile of the elongated light source 42 broadens and consequently also the microscopic light distribution 43 becomes broader.

The line-growth factors can be obtained from the microscopic light distributions. Let us suppose that the process level of the photosensitive material for exposing the black matrix structure is fixed at an arbitrary level, which in the FIGS. 7A–F is denoted by 1 along the 'intensity' axis. In this case, for obtaining a MWW of 150 $\mu$m, the microscopic light distribution should be increased such that it crosses the lines 44 at intensity level 1. The reciprocal slope of the microscopic light distribution where it crosses the lines 44 now gives the line-growth factors. By increasing the intensity of the microscopic light distribution by 1%, an MWW increase by a given number of microns is obtaind because the process level is fixed, which is precisely the definition of the line-growth factor.

Figure 8:
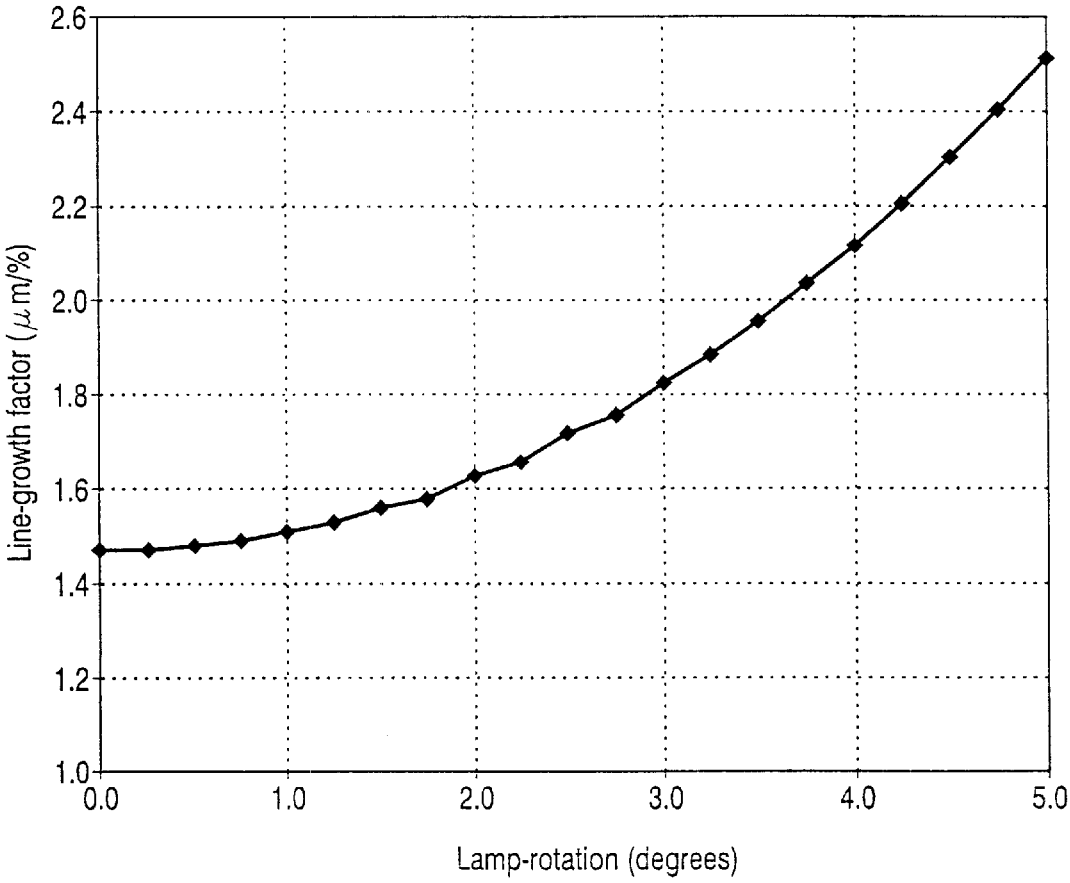
FIG. 8 is the line-growth factor as a function of the lamp rotation.

The results of the line-growth factor as a function of the lamp-rotation are given in FIG. 8. The values corresponding to the FIGS. 7A–F are given in Table 2

TABLE 2

Line-growth factors for different lamp-rotations

| Lamp rotation (degrees) | Line-growth factor $\mu$m/%) | Line-growth factor (in %, relative to $\phi$ = 0°) |
|---|---|---|
| 0 | 1.47 | 100 |
| 1 | 1.51 | 103 |
| 2 | 1.63 | 111 |
| 3 | 1.83 | 124 |
| 4 | 2.12 | 144 |
| 5 | 2.52 | 171 |

The Table shows that by increasing the lamp-rotation from 0° to 5°, the line-growth factor increases from 1.47 to 2.52, which is a relative increase by 71%. In the design of color display tubes 1, this makes it possible to design a lens 35 or 36 for the exposure equipment in such a way that the line-growth factors over the entire screen 6 become equal, or at least substantially equal, so that the performance of the color display tube 1 is improved, because the performance—and more in particular, the luminance distribution—is less sensitive to variations of the amount of light used during the exposure process.

Summarizing, the invention relates to a method of producing a screen 6 having a striped structure of electroluminescent material on a display window 3 of a color display tube 1. In present day color display tubes 1, this screen 6 is produced using a photochemical process for exposing a photosensitive material which is applied to the display window 3. Normally, the exposure device used for this process comprises two lenses, a first lens 28 for correcting the rotation of the image of the elongated light source 22 and a second lens 27 for taking care that the landing position of the light on the display window 3 will be representative of the landing position of the electron beams 7, 8, 9 in the color display tube 1 when it is operated. Unfortunately, this system has the disadvantage that the line-growth factor is not constant over the entire screen 6. As a result, a change in the amount of light in the exposure process leads to a change in the distribution of the line width over the screen 6 and hence to a change of the luminance distribution. This invention provides a solution to this problem by introducing a third lens element 35 into the exposure device. This lens element 35, that breaks the four-quadrant symmetry of the prior art system, enables a deliberate and controlled rotation of the image of the elongated light source 22 on the screen 6 in such a way that the line-growth factor is made constant over the entire screen 6. In a preferred embodiment, the first lens 28 and the third lens 35 are integrated to form one lens 36.

What is claimed is:

1. A method of producing a screen (6) having a striped structure of electroluminescent material on a display window (3) of a color display tube (1), which method comprises exposing a photosensitive material on the display window (3) to light emitted by a elongated light source (22) and passed through a lens system and a shadow mask (13), which shadow mask (13) is suspended from the display window (3) and which lens system is positioned between the elongated light source (22) and the shadow mask (13), the lens system, forming an image of the elongated light source (22) on the screen (6), comprising a first element (28) for substantially correcting the rotation of the image of the elongated light source (22) and a second element (27) for substantially determining the landing position, characterized in that the lens system further comprises a third element (35) which is provided with means for adjusting the rotation of the image of the elongated light source (22) over the entire screen (6).

2. A method of producing a screen (6) as claimed in claim 1, characterized in that the third element (35) comprises a lens breaking the four-quadrant symmetry.

3. A method of producing a screen (6) as claimed in claim 2, characterized in that the first element (28) and the third element (35) are combined to form an integrated element (36).

4. A method of producing a screen (6) as claimed in claim 3, characterized in that the integrated element (36) has a first side comprising both the first element and the third element.

5. A colour display tube (1) provided with a screen (6) which is produced using the method of claim 1.

6. A color display tube (1) as claimed in claim 5, characterized in that the striped structure extends in a zigzag way in an area of the screen (6) passing through the centre of the screen and extending parallel to the striped structure.

* * * * *